United States Patent [19]

Lee et al.

[11] Patent Number: 4,741,059

[45] Date of Patent: May 3, 1988

[54] REORGANIZABLE TOOL FOR VARIOUS PURPOSES

[75] Inventors: Yung-Hsiang Lee, Linkow Hsiang; Yau-Zung Pan, 4th Fl., 22 Kan Chou St., Taipei, both of Taiwan

[73] Assignee: Yau-Zung Pan, Taiwan

[21] Appl. No.: 23,660

[22] Filed: Mar. 9, 1987

[51] Int. Cl.[4] ..... B25F 1/02

[52] U.S. Cl. ..... 7/127; 7/143

[58] Field of Search ..... 7/125, 127, 137, 143

[56] References Cited

U.S. PATENT DOCUMENTS

| | | | |
|---|---|---|---|
| 1,404,866 | 1/1922 | Lahr | 7/130 |
| 1,748,673 | 2/1930 | Hurst | 7/133 |

FOREIGN PATENT DOCUMENTS

| | | | |
|---|---|---|---|
| 863480 | 1/1953 | Fed. Rep. of Germany | 7/130 |
| 720495 | 12/1931 | France | 7/127 |
| 441837 | 11/1948 | Italy | 7/137 |

*Primary Examiner*—Roscoe V. Parker

*Attorney, Agent, or Firm*—Wenderoth, Lind & Ponack

[57] ABSTRACT

A combined tool unit constructed so as to be disassembled and reorganized into various independent tools. The tool unit includes a cylindrical hammer portion which can be received between a pair of hand grips of a tongs portion in the storage position of the tool unit. The hammer portion can be fixedly mounted on the closed jaws of the tongs portion to form an independent hammer. A saw blade can be removed from one of the hand grips of the tongs portion and locked into one end of the hammer portion to form an independent saw. A screwdriver bit can be removed from another end of the hammer portion and locked into the same end of the hammer portion where the saw blade can be locked, to form an independent screwdriver. The tongs when disassembled from the hammer portion can be used as a conventional pair of pincers. The hammer portion when disassembled from the tongs portion can be used as a knife by sliding a knife blade, which normally resides in a groove of the hammer portion, outwardly therefrom to thereby form an independent knife.

10 Claims, 4 Drawing Sheets

REORGANIZABLE TOOL FOR VARIOUS PURPOSES

FIELD OF THE INVENTION

This invention relates to a tool construction, particularly for that of a tool unit that can be disassembled and reorganized to be a special tool, such as, a hammer, a pair of tongs, a crowbar, a screwdriver, a knife or a saw, for example.

BACKGROUND OF THE INVENTION

The conventional tools usually have one purpose and are formed in one unit, such as, an independent hammer, tongs, crowbar, screwdriver, knife or saw, etc. Whenever any of these tools is to be used, it is usually selected from among those in a tool box. Occassionally, people find that some of these tools are missing. On the other hand, such a tool box is rather cumbersome for a user when it is to be carried, especially for a homeowner or a student performing do it yourself (DIY) work. Also, do it yourself work requires tools which are preferably compact in size, have multiple uses and are easy to carry whereas tools for professional use have a high working efficiency.

SUMMARY OF THE INVENTION

The present invention achieves the aforementioned objectives by providing a tool unit which has a smooth configuration when it is not being used, but the tool unit can be disassembled and reorganized into a particular tool when it is so desired.

One object of the present invention is to provide a tool unit constructed such a that it can be reorganized as a hammer, a pair of tongs, a crowbar, a screwdriver, a knife or a saw, each of which may be used for different purposes.

Another object of the present invention is to assemble or retract all of the inventive parts into a tool unit which has a smooth outline and a relatively compact size such that it can be easily carried by users.

Other functional and structural objects will become apparent from the following description taken in conjunction with the accompanying drawings.

DESCRIPTION OF THE PREFERRED EMBODIMENT

Figure 1:
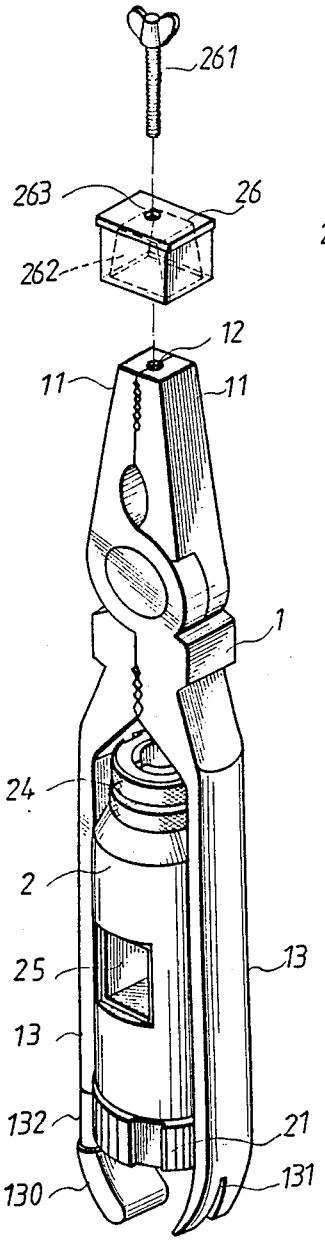
FIG. 1 is a perspective view of the device according to the invention showing all of the parts thereof in the retracted condition and assembled into a tool unit which has a smooth outline.
Figure 2:
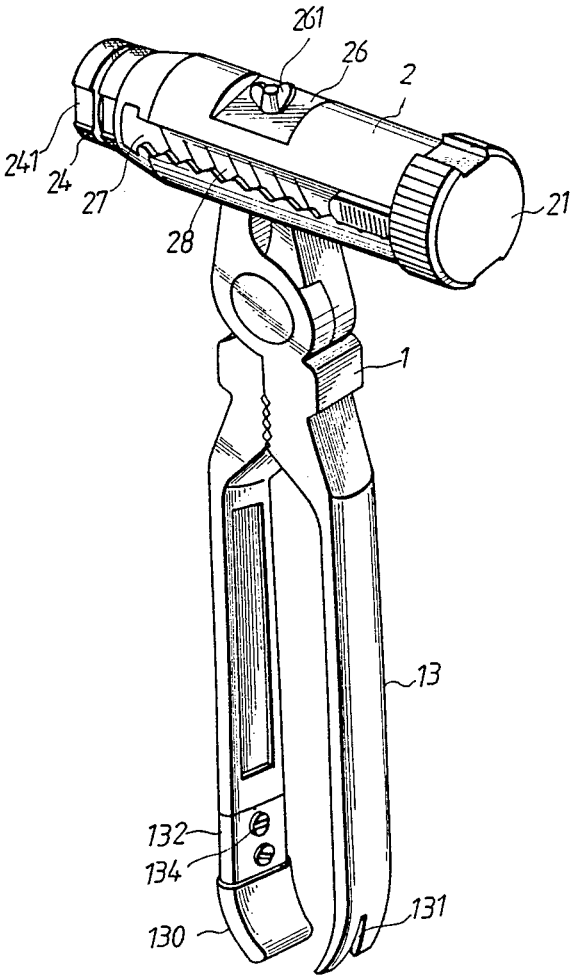
FIG. 2 is a perspective view of the inventive tool unit which has been disassembled and reorganized into a hammer, wherein portion 2 is a hammer head and a pair of tongs is a handle.

Referring now to FIGS. 1 and 2, it will be seen that the present invention comprises two main portions, a hammer portion 2 and a pair of tongs (or pincers) portion 1.

The tongs portion 1 includes a pair of members, each of which has a jaw 11 at one end thereof and a handle grip 13 at the other end thereof. The tongs operate in the conventional manner by operating the handle grips 13 to open and close the jaws 11.

The jaws 11, when in the closed position, include a threaded opening 12 at the center of the abutting faces of the jaws 11 and extending along the longitudinal direction thereof, such that it extends through an end face of the closed jaws 11. A cap 26 has a tapered recess 262 sized to receive the jaws in the closed position such that the end face of the jaws faces a bottom of the recess 262. A turnable screw 261 is provided for penetrating through an opening 263 in the cap 26 and screwing into threaded engagement with the threaded opening 12 of the pair of tongs 1 so as to fix the pair of pincers (tongs 1) together in the closed position.

The hammer portion 2 can be placed between the handle grips 13 of the tongs portion 1 and when the tongs 1, FIG. 1, are placed in the closed position, the cap 26 can be placed over the jaws 11 as aforementioned, whereby the tongs portion 1 and the hammer portion 2 of the present invention are then assembled into a tool unit which can readily be carried by a user.

The tool unit is disassembled by removing the screw 261 and the cap 26 from the tongs 1. The hammer portion 2 includes a through opening 25 for receiving the cap 26 and the closed jaws 11 of the tongs 1, the opening 25 (FIG. 1) being provided in a middle portion of the hammer portion 2 and extending radially inwardly from an outer periphery thereof. The cap 26 together with the jaws 11 of the tongs 1 are held in the opening 25 by means of the screw 261 which extends through an end wall of the cap 26 in the same manner as shown in FIG. 1. As shown in FIG. 2, the handle grips 13 of the tongs 1 form a handle of a hammer.

As shown in FIG. 2, the sidewalls of the cap 26 are slidably received in the opening 25 of the hammer portion 2 and the end wall of the cap 26 extends beyond the sidewalls to form an abutment to prevent the cap 26 from passing through the opening 25 in the hammer portion 2. Thus, the hammer portion 2 is held between the cap 26 and the tongs portion 1 as described above and as shown in FIG. 2.

Figure 8:
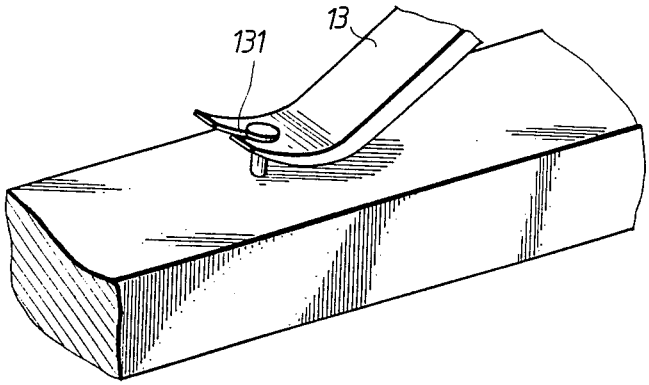
FIG. 8 is a fragmentary perspective view of the inventive crowbar which is integrally formed at one end of one of the grips of the tongs.

The handle grips 13 are bow-shaped in cross section taken in a direction perpendicular to the longitudinal direction thereof, the free ends of the grips 13 extending toward each other so as to embrace the hammer portion 2 therebetween and enable a user to grip them easily. One free end of the handle grips 13 is bent inwardly and has a cross section which becomes thinner towards the free end, the free end being provided with a V-shaped split 131 thereat, FIGS. 1 and 2, for prying up a nail, as shown in FIG. 8.

Figure 9:
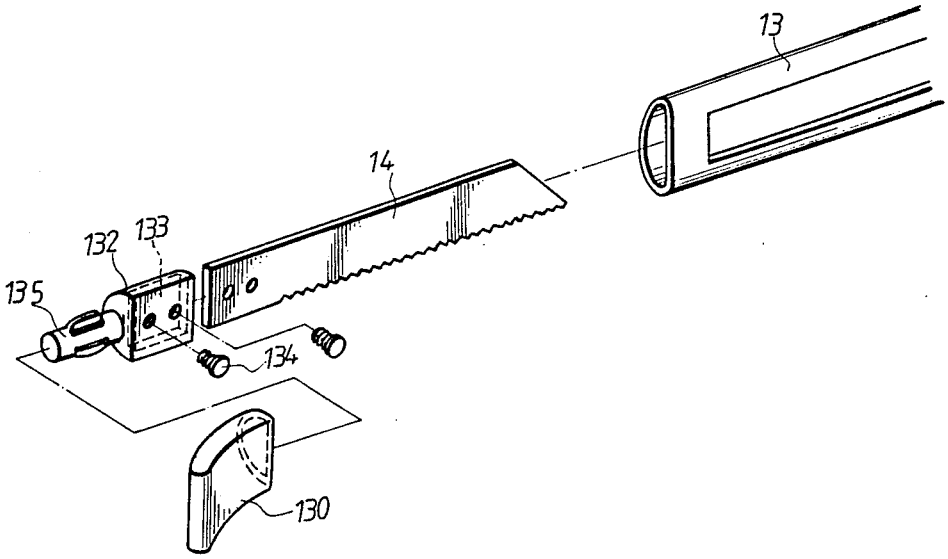
FIG. 9 is a fragmentary perspective view of the invention showing a saw blade 14 which is drawn out from another grip of the inventive tongs.

The other handle grip 13 is hollow and open at the free end thereof for holding a saw blade 14 therein (FIG. 9). The saw blade 14 is fixed to an abutment portion 132, shaped like a part of the hand grip, by means of screws 134 which pass through openings at one end of the saw blade 14 and into the threaded engagement with similarly aligned holes in the abutment portion 132. The abutment 132 serves as a hilt for restricting the depth of insertion of the saw blade 14 into the hollow handle grip 13 and thus allows easy removal of the saw blade 14 from the hollowed grip 13.

A joint portion 135 extends from the abutment portion 132 in a direction away from the saw blade 14 and serves as a driving connection which is received in an end of the hammer portion 2 (which when separated from the tongs 1 serves as a handle for the saw or for a screwdriver).

A bent hollow end portion 130 receives the joint portion 135 therein and fits over the abutment portion 132, as shown in FIG. 1, and the saw blade 14 is received inside the hollowed grip 13. In this condition, the hollowed grip can form part of the tongs 1 or a handle of a hammer.

Figure 7:
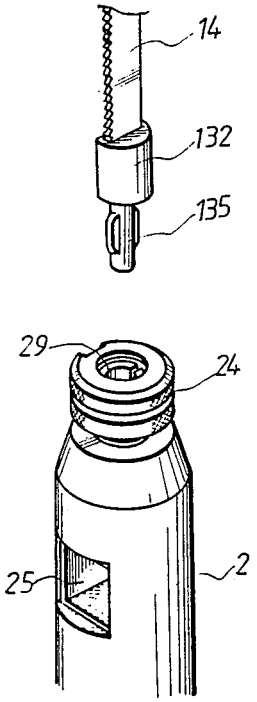
FIG. 7 is a perspective view of the inventive saw showing a saw blade positioned for insertion into the portion 2.

By simply removing the end portion 130, the saw portion (blade 14 and hilt 132) can be drawn out from the hollow grip 13 to fit into one end of the hammer portion 2 so as to become an independent saw, FIG. 7.

Figure 3:
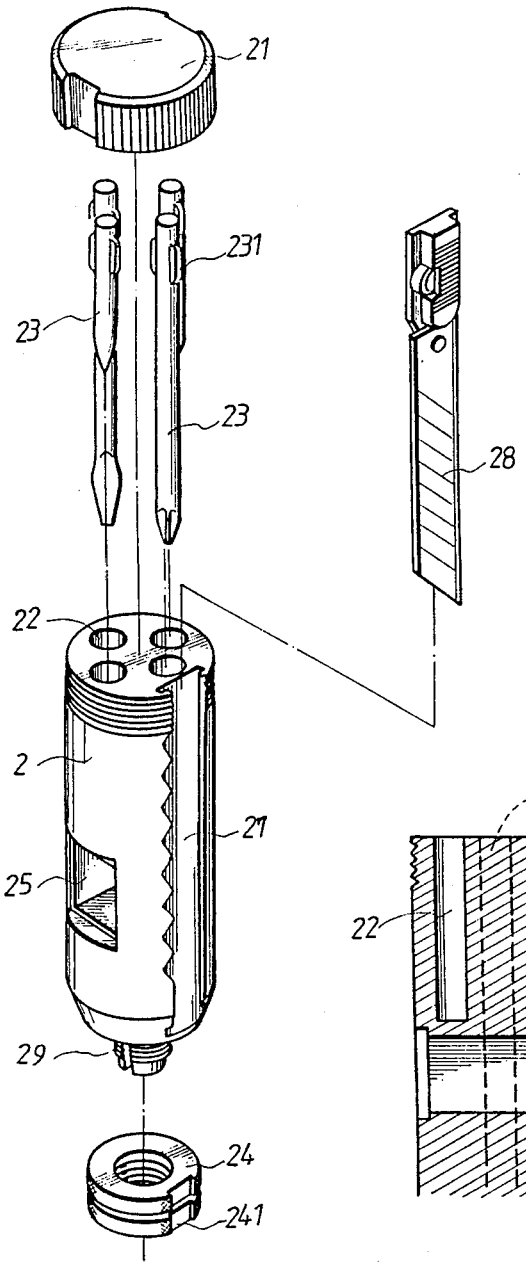
FIG. 3 is a perspective view of the inventive hammer portion 2 showing screwdriver bits 23 and a blade 28 which are retractable therein.

The hammer portion 2 is made of hard metal and is shaped as a cylinder, one end surface of the hammer portion 2 being provided with a plurality of straight holes 22 therethrough, the holes 22 extending along the longitudinal direction into the hammer portion 2 and adapted for receiving respective screwdriver bits 23 (FIG. 3). A screw cap 21 is provided for covering the end surface, the screw cap 21 serving as a head portion of the hammer when the tool unit of the present invention is reorganized as illustrated in FIG. 2.

Figure 6:
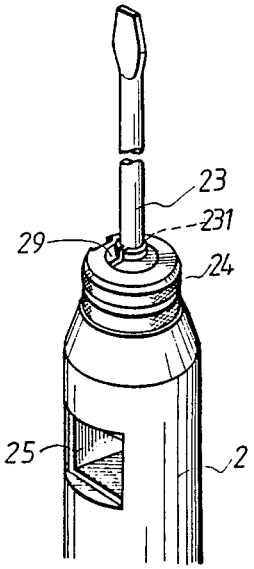
FIG. 6 is a perspective view of the inventive screwdriver showing one of the screwdriver bits 23 operatively joined to the portion 2.

At the center of the opposite end side of the hammer portion 2, there is provided an expandable and closable collet 29 which fits into the hammer portion along the longitudinal direction thereof. A screw nut 24 is threadedly received around the collet 29 to tighten or loosen the collet 29 depending upon the direction of turning of the screw nut 24. A screwdriver bit 23 having a joint portion 231, formed by a pair of radially outwardly extending flanges receivable in similarly sized slots in the collet, is slidably received in the collet 29 and held therein by turning the screw-nut 24 to lock the screwdriver bit 23 therein and form an independent screwdriver as shown in FIG. 6, whereby the hammer portion 2 forms a grip of the screwdriver.

Similarly, when the joint portion 135 of the saw 14 (FIG. 7) is placed in the collet 29 and fixed therein by means of the screw-nut 24, the hammer portion 2 together with the saw blade 14 forms an independent saw.

Figure 4:
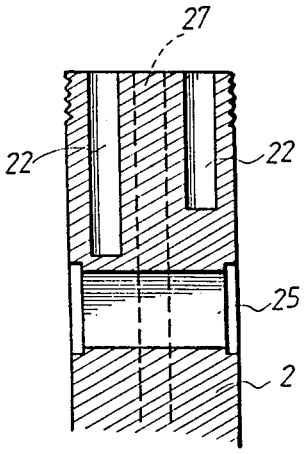
FIG. 4 is a lengthwise sectional view of the hammer portion 2 along the longitudinal direction thereof.
Figure 5:
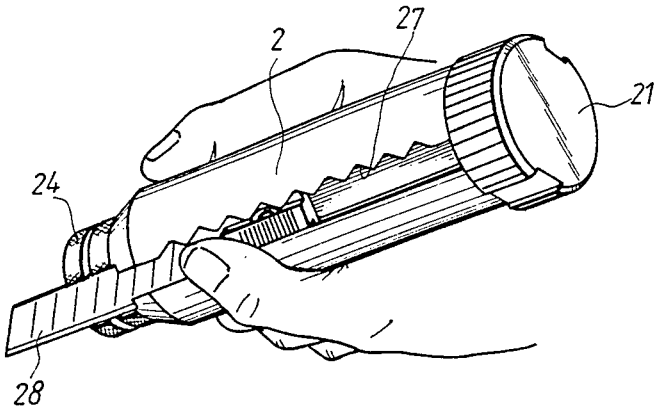
FIG. 5 is a perspective view of the inventive knife, wherein a blade 28 partly slides out from the portion 2, and the portion 2 is used as a knife grip.

A groove 27 is formed in the outer periphery of the hammer portion 2, the groove 27 extending in the longitudinal direction and on the surface of the hammer portion 2 at a position offset from the opening 25, as shown in FIG. 4. The groove 27 serves as a track for a blade 28 which is slidably received therein. The blade 28 is placed in the groove 27 before attaching the screw cap 21 forming the hammer head, and by sliding the blade 28 through a groove 241 provided on the outer periphery of the screw nut 24, as shown in FIG. 2, an independent knife is formed, as shown in FIG. 5, in which the hammer portion 2 forms the grip of the knife.

The groove 241 of the screw nut 24 supports the blade 28 firmly so as to prevent the blade from being broken when in use. As shown in FIGS. 2, 3 and 5, the groove 27 includes a series of teeth along one longitudinal edge thereof for engaging a detent formed on one end of the blade 28 to thereby hold the blade 28 in a desired position along the hammer portion 2.

We claim:

1. A combined tool unit which can be disassembled and reorganized into various independent tools comprising:

a hammer portion;

a tongs portion;

said hammer portion having a cylindrical shape extending in a longitudinal direction and being of a hard metallic material;

said tongs portion including a pair of members having jaws at one end thereof and hand grips at the other end thereof, the members being pivoted together and including means for holding said hammer portion between said hand grips when said jaws are closed together; and a cap means for holding said jaws together in a closed position, whereby said cap means maintains said hand grips of said tongs portion such that the hammer portion and tongs portion are held together as a tool unit.

2. A combined tool unit as set forth in claim 1, wherein said hammer portion includes a collet at one end thereof and a screw nut is provided which is threadedly received on said collet for tightening and loosening said collet by rotating the screw nut in respective directions, the tool unit further including at least one screwdriver bit receivable in said collet whereby said hammer portion is usable as a grip supporting said screwdriver bit which together form an independent screwdriver.

3. A combined tool unit as set forth in claim 2, wherein said at least one screwdriver bit comprises a plurality of screwdriver bits, each of which is received in a respective one of a plurality of straight holes provided at the other end of said hammer portion and extending in said longitudinal direction, said tool unit further comprising a hard metallic cap attachable to said other end of said hammer portion to hold said screwdriver bits inside said holes.

4. A combined tool unit as set forth in claim 1, wherein said hammer portion includes a groove extending in said longitudinal direction along an outer periphery of said hammer portion, the tool unit further including a knife blade slidably received in said groove, such that when said knife blade is slid outwardly of said hammer portion an independent knife is formed wherein said hammer portion acts as a knife grip.

5. A combined tool unit as set forth in claim 1, wherein said cap means comprises a cap fitted over said jaws of said tongs portion, said cap having a recess shaped to receive an outer periphery and end face of said jaws in the closed position, the cap having an end wall extending outwardly from side walls forming said recess, said hammer portion having a radially extending through opening at a middle portion thereof, said opening being sized to receive said sidewalls of said cap but preventing said end wall of said cap from passing therethrough, whereby the sidewalls of the cap are fitted in one end of said opening of the hammer portion and said jaws of the tongs portion are fitted in the other end of said opening such that the jaws are received in said recess in said cup, the tool unit further including locking means for securing said tongs portion within said opening of said hammer portion whereby said tongs portion supports and extends perpendicularly from said hammer portion to form an independent hammer.

6. A combined tool unit as set forth in claim 5, wherein said locking means comprises a turnable screw, an opening through the center of the end wall of the cap, and a threaded opening formed in the confronting faces of said jaws when said jaws are in said closed position whereby said turnable screw can extend through said opening in said end wall of said cap and into threaded engagement with said threaded opening of the closed jaws to tightly secure said hammer portion to said tongs portion.

7. A combined tool unit as set forth in claim 2, wherein one of said hand grips is hollow and said tool unit further includes a saw blade having means at one end thereof for mounting said saw blade in said collet, said saw blade being receivable in said hollow hand grip.

8. A combined tool unit as set forth in claim 7, wherein a free end of said hollow hand grip includes an opening therethrough for receiving said saw blade therein.

9. A combined tool unit as set forth in claim 4, wherein said groove includes a series of teeth and said knife includes detent means thereon for engaging said teeth to position said knife at a desired position.

10. A combined tool unit as set forth in claim 1, wherein said hammer portion includes a collet at one end thereof and a screw nut is provided which is threadedly received on said collet for tightening and loosening said collet by rotating said screw nut in respective directions, the tool unit further including a saw blade having means at one end thereof for mounting said saw blade in said collet.

* * * * *